US006810542B1

(12) United States Patent
Mitchell

(10) Patent No.: US 6,810,542 B1
(45) Date of Patent: Nov. 2, 2004

(54) LYMPHATIC PUMP APPARATUS

(76) Inventor: Charles H. Mitchell, Rte. 1, Box 198, Pauls Valley, OK (US) 73075

( * ) Notice: Subject to any disclaimer, the term of this patent is extended or adjusted under 35 U.S.C. 154(b) by 0 days.

(21) Appl. No.: 10/390,489

(22) Filed: Mar. 17, 2003

Related U.S. Application Data

(60) Provisional application No. 60/365,681, filed on Mar. 18, 2002, now abandoned.

(51) Int. Cl.[7] ..... A61G 15/00
(52) U.S. Cl. ..... 5/630; 5/633; 5/644
(58) Field of Search ..... 5/630, 632, 633, 5/644

(56) References Cited

U.S. PATENT DOCUMENTS

| | | | | |
|---|---|---|---|---|
| 1,772,310 A | | 8/1930 | Hart | |
| 3,811,140 A | | 5/1974 | Burpo | |
| 4,175,297 A | | 11/1979 | Robbins | |
| 4,207,878 A | | 6/1980 | Duncan | |
| 4,867,140 A | | 9/1989 | Hovis | |
| 5,279,310 A | * | 1/1994 | Hsien | 5/632 |
| 5,453,081 A | | 9/1995 | Hansen | |
| 5,792,082 A | | 8/1998 | Yamanaka et al. | |
| 5,820,573 A | | 10/1998 | Ramos | |
| 5,938,627 A | | 8/1999 | Hickman | |
| 6,041,457 A | | 3/2000 | Summers | |
| 6,065,166 A | | 5/2000 | Sharrock et al. | |
| 6,179,796 B1 | | 1/2001 | Waldridge | |
| 6,212,719 B1 | * | 4/2001 | Thomas et al. | 5/713 |
| 6,254,556 B1 | | 7/2001 | Hansen et al. | |
| 6,269,505 B1 | | 8/2001 | Wilkinson | |
| 6,315,744 B1 | | 11/2001 | Inaba | |
| 6,315,745 B1 | | 11/2001 | Kloecker | |
| 6,327,727 B1 | | 12/2001 | Bocharnikov | |
| 6,361,397 B1 | | 3/2002 | Mankovitz et al. | |
| 6,361,512 B1 | * | 3/2002 | Mackay et al. | 601/150 |
| 6,370,716 B1 | | 4/2002 | Wilkinson | |

OTHER PUBLICATIONS

Degenhardt, D.O., Brian F., and Kuchera, D.O., Michael L., "Update on Osteopathic Medical Concepts and the Lymphatic System," Journal of the American Osteopathic Association, Feb. 1996, pp. 97–100, vol. 96, No. 2, American Osteopathic Association, United States.

* cited by examiner

*Primary Examiner*—Teri Pham Luu
*Assistant Examiner*—Fredrick Conley
(74) *Attorney, Agent, or Firm*—Mary M. Lee

(57) ABSTRACT

A lymphatic pump apparatus for use under the thoracic cage of a human patient in a supine position. The apparatus comprises a mat which supports a pair of longitudinal lifting members positioned to be parallel to and on opposite sides of the spine under the angle of the ribs. The apparatus provides intermittent rib cage excursion, or anterior displacement of the ribs, to assist and increase lymphatic flow. Enhancement of lymphatic flow is beneficial in numerous disease states characterized by capillary leak and abnormal excursion of fluids and proteins into the interstitial spaces.

16 Claims, 4 Drawing Sheets

LYMPHATIC PUMP APPARATUS

This application claims the benefit of the filing date of provisional application Ser. No. 60/365,681, entitled "Lymphatic Pump Apparatus," filed Mar. 18, 2002, now abandoned, the contents of which are incorporated herein by reference.

FIELD OF THE INVENTION

The present invention relates to devices for lifting and manipulating the thoracic cage to improve lymphatic flow.

BACKGROUND OF THE INVENTION

In several severe disease states, there is an increase in capillary leak resulting in an abnormal fluid and protein shift into the interstitial spaces. Such disease states include, for example, systemic inflammatory response syndrome and septic shock. This fluid shift may result in ascites, hepatic congestion and other forms of organ congestion, which may be fatal. There is a need for an apparatus that will combat this dangerous fluid dysfunction by enhancing lymphatic flow.

SUMMARY OF THE INVENTION

The present invention is directed to a lymphatic pump apparatus for use under the thoracic cage of a human patient in a supine position. The apparatus comprises a mat sized to fit under the patient's thoracic cage while the patient is in a supine position. The apparatus also includes a lifting assembly comprising at least one lift member provided in the mat. The lifting assembly is movable between a retracted position and an extended position and adapted in size and position to lift and lower at least one side of the thoracic cage of the patient. A control assembly is provided to control the lifting assembly to provide intermittent movement of the lifting member.

DETAILED DESCRIPTION OF THE PREFERRED EMBODIMENT

Figure 1:
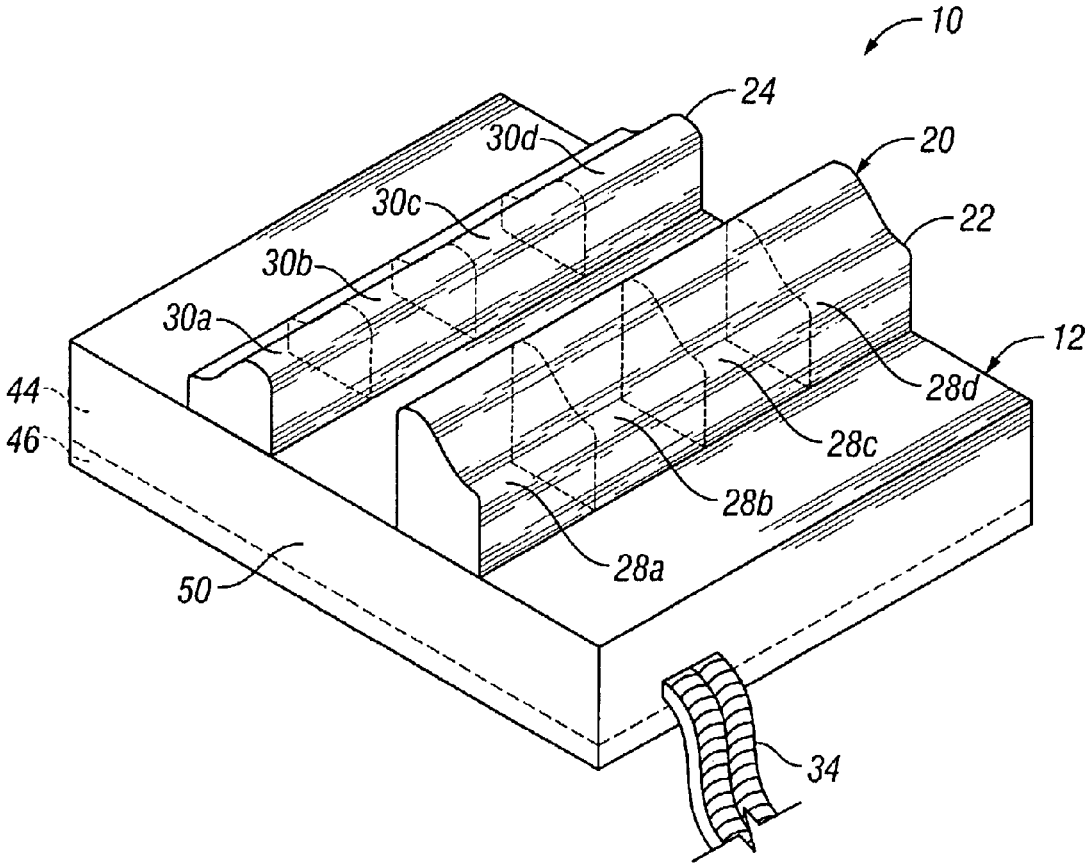
FIG. 1 is a perspective view of a lymphatic pump apparatus constructed in accordance with the present invention.
Figure 2:
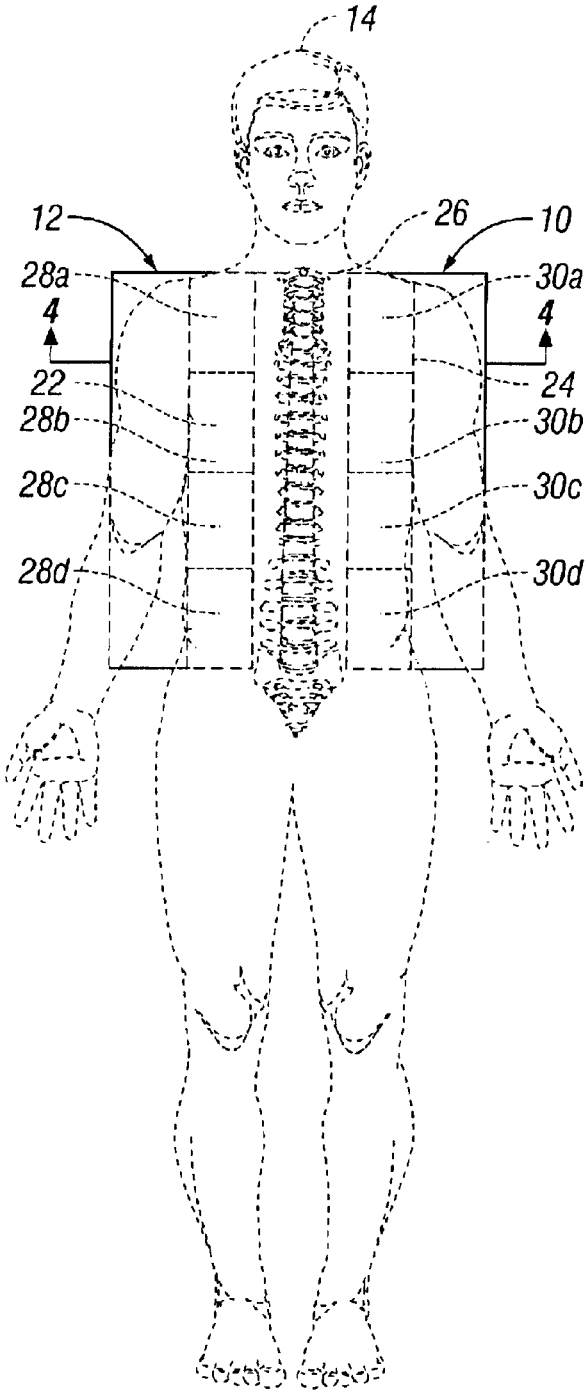
FIG. 2 is a plan view of the apparatus positioned under a patient (shown in phantom).
Figure 3:
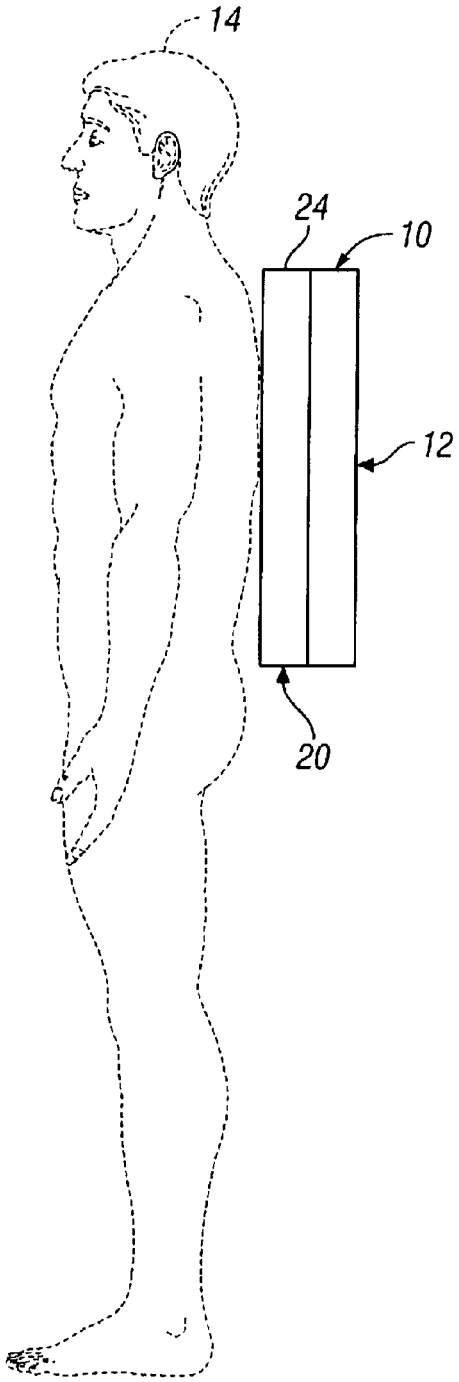
FIG. 3 is a side view of the apparatus positioned under a patient (shown in phantom).

Turning now to the drawings in general and to FIG. 1 in particular, there is shown therein and designated by the reference numeral 10 a lymphatic pump apparatus made in accordance with the present invention. The apparatus 10 is designed for use under the thoracic cage of a human patient in a supine position, as illustrated in FIGS. 2 and 3.

The apparatus 10 comprises a mat 12 sized to fit under the patient's thoracic cage while the patient 14 is in a supine position. The overall size of the apparatus 10 and its mat 12 relative to the patient's body may vary. In addition, the present invention contemplates mats of different sizes to accommodate patients of different sizes from children to large or tall adults.

The apparatus 10 further comprises a lifting assembly 20. The lifting assembly comprises at least one lifting member, and preferably a pair of lifting members 22 and 24, provided in the mat 12. Each lifting member 22 and 24 is movable an extended position and a retracted position. In FIG. 1, the lifting member 22 is in the extended position and the lifting member 24 is in the retracted position. In a manner to be described in more detail hereafter, each lifting member 22 and 24 is adapted in size and position on the mat to lift and lower one side of the patient's thoracic cage. Thus, as shown in FIGS. 2 and 3, the preferred lifting members 22 and 24 are elongate members, each of which is positioned in the mat 12 lateral to the spine 26 of the patient 14 and generally under the angle of the ribs (not shown). One lifting member 22 is adapted to lift and lower the left side of the thoracic cage of the patient 14. The other lifting member 24 is adapted to lift the Tight side of the thoracic cage of the patient 14.

Preferably, the lifting members 22 and 24 run parallel to the vertebral column from approximately at least the fourth thoracic vertebrae (T4) to approximately at least the tenth thoracic vertebrae (T10) and lying just underneath the angle of the ribs. More preferably, each lifting member 22 and 24 runs parallel to the vertebral column from approximately at least the first thoracic vertebrae (T1) to approximately at least the twelfth thoracic vertebrae (T12).

Figure 4:
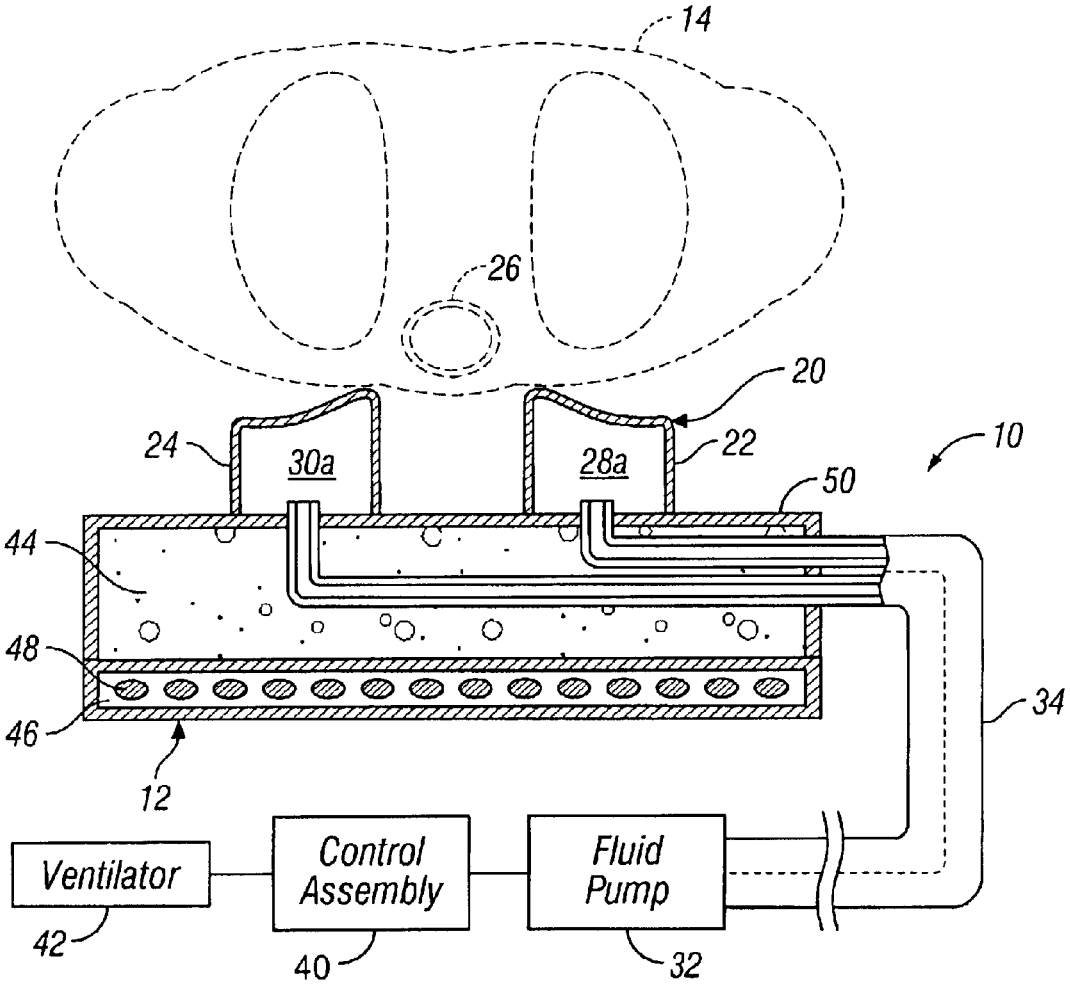
FIG. 4 shows a cross sectional view of the apparatus positioned under a patient (shown in phantom) in a supine position.

With reference now to FIG. 4, a preferred mechanism for operating the lifting assembly 20 will be described. In the preferred construction, each of the lifting members 22 and 24 comprises at least one inflatable chamber. The fluid media used for inflation may be air or some other gas or a liquid such as water. More preferably, each comprises a plurality of lifting chambers 28*a–d* and 30*a–d*, respectively.

In this embodiment, then, a fluid pump 32 will be included for inflating and deflating the lifting members 22 and 24. The fluid pump 32 may be fluidly connected to the chambers 28*a–d* and 30*a–d* by a system of conduits designated collectively at 34. For optimum effectiveness, the lifting member 22 and 24 should extend and retract very rapidly. Various pump/vacuum devices are commercially available for this purpose.

It is advantageous to include in the apparatus 10 a control assembly 40 adapted to control the lifting assembly to provide intermittent movement of the lifting members 22 and 24. The control assembly 40 may be used to control the fluid pump 32, as well as several other variables which may be involved in the operation of the apparatus 10. Where the lifting members 22 and 24 comprise multiple chambers, such as the chambers 28*a–d* and 30*a–d*, the control assembly 40 may be adapted to selectively and separately inflate one or more of the chambers. In its most preferred form, the control assembly 40 will be designed to inflate the lifting members 22 and 24 alternatingly, so that only one side of the patient's chest is lifted at a time.

The control assembly 40 may be programmable to provide selective frequency, duration and sequence of the extension of the lifting members. Still further, the control assembly 40 may be programmed to provide cycles of operating and rest phases of predetermined duration and frequency. To optimize the therapeutic effect of the apparatus, the volume of each chamber or compartment may be varied in order to achieve the preferred amount of displacement, expansion or excursion of the chest wall. Suitable control devices are commercially available, such as those used for cardiovascular compression systems and the like.

The control assembly 40 may be adapted to operate the lifting assembly 12 automatically with an artificial respirator, such as a ventilator 42 (FIG. 4), Bi-pap machine, C-pap machine or any other form of artificial respiratory device. In this way, expansion and contraction of the lifting members 22 and 24, and the concomitant rib cage excursions, may be coordinated with the phases of respiration, i.e., inhalation and exhalation. In addition, respiration sensors (not shown) may be used to provide data to the control assembly 40 indicating the patient's natural or unassisted breathing pattern. In this way, operation of the apparatus 10 may be coordinated with the patient's inhalation and exhalation.

With continued reference to FIG. 4, the structure of the mat 12 will be described. For the patient's comfort, the mat 12 may comprise an upper layer 44 made of foam or another suitable resilient material. For support, the mat 12 may be provided with a second support layer 46 comprising ribs 48, stays or bars, which may run transversely or parallel, or both. The mat 12 preferably will also include a cover 50 made of suitable material.

Having described the structure of the apparatus 10, its use will now be explained. The function of the lymphatic pump apparatus 10 is to cause thoracic rib cage excursion or anterior displacement of the ribs while the patient is in a supine position. This will increase lymphatic flow. While not wishing to be bound by theory, it is believed that the increase in lymphatic flow is generated by pressure gradients caused by the rib cage excursion. Other contributing factors may be the effect on the diaphragm on such pressure gradients, as well as other possible effects on the autonomic nervous system.

Figure 5A:
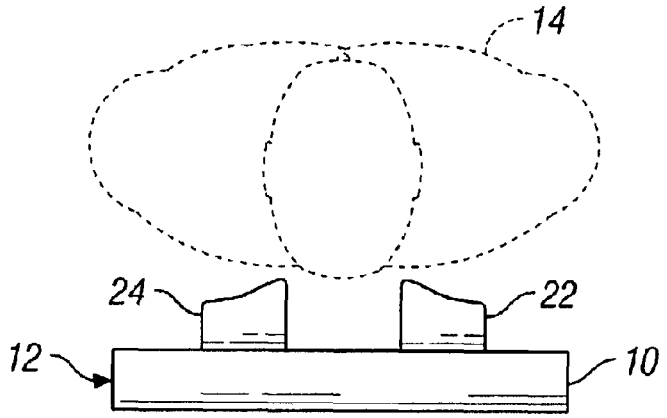
FIGS. 5A–5C show sequential operation of the lymphatic pump apparatus under a human torso.
Figure 5B:
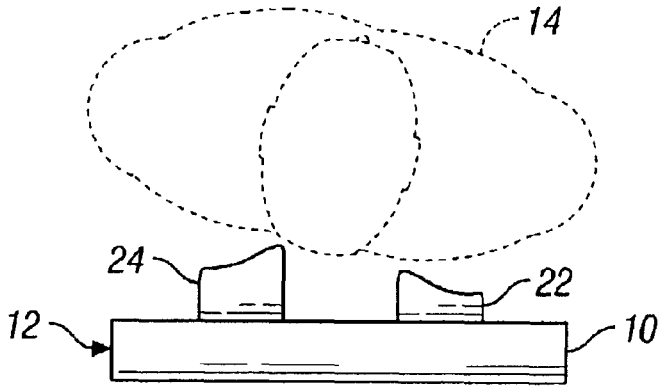
Figure 5C:
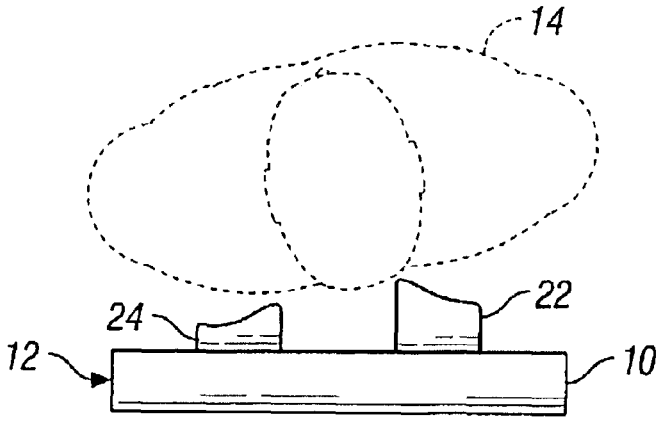

The apparatus 10 is properly positioned under the patient 14, as illustrated best in FIGS. 2–4. The patient's medical parameters are studied, and a course of treatment is prescribed whereby the apparatus 10 will be operated according to predetermined parameters. The operation of the apparatus 10 is illustrated in FIGS. 5A–C. In FIG. 5A, the apparatus 10 is shown with the lifting members 22 and 24 both in the retracted position. In FIG. 5B, the left side of the patient's chest is raised by extension of the lifting member 24, while the lifting member 22 is retracted. In FIG. 5C, the right side of the patient's chest is raised by extension of the lifting member 22, while the lifting member 24 is retracted. This process is repeated automatically in the prescribed pattern, and for the prescribed duration. The patient's clinical signs are monitored so that the operation of the apparatus 10 can be adjusted, or terminated, as indicated.

The apparatus of the present invention, thus, may be used as a treatment aid in removing excess interstitial fluid, i.e., edema, from tissues and organ systems in the thoracic and abdominal areas, and other bodily organs and parts. Increase lymphatic flow will promote reclamation of proteins and albumen from the interstitial space, aide the immune system, move toxins and endotoxins from the interstitial space into the lymph fluid, which in turn is delivered to the venous system.

The present invention may be used in the treatment of any disease or disease states where increased lymphatic flow will have a beneficial effect. Such disease states include but are not limited to those disease states where there is an increase in capillary leak, such as occurs with systemic inflammatory response syndrome and septic shock. More specifically, the lymphatic pump apparatus of this invention may be used in the treatment of and the consequences of capillary leak and dysfunction, such as in acute respiratory distress syndrome, ascites, hepatic congestion and other forms of organ congestion where increased lymphatic flow would promote a beneficial effect. Of course, use of the apparatus 10 may be contraindicated in patients with chest trauma or other conditions that would be adversely affected by repeated manipulation of the thorax.

Changes can be made in the combination and arrangement of the various parts and elements described herein without departing from the spirit and scope of the invention.

What is claimed is:

1. A lymphatic pump apparatus for use under the thoracic cage of a human patient in a supine position, the apparatus comprising:

a mat sized to fit under the patient's thoracic cage while the patient is in a supine position; and a lifting assembly comprising at least one lift member provided in the mat, the lifting member movable between a retracted position and an extended position and adapted in size and position to lift and lower at least one side of the thoracic cage; and a control assembly adapted to control the lifting assembly to provide intermittent movement of the lifting member.

2. The lymphatic pump apparatus of claim 1 wherein the at least one lifting member comprises two lifting members, including one lifting member adapted to lift the left side of the patient's thoracic cage and one lifting member adapted to lift the right side of the patient's thoracic cage.

3. The lymphatic pump apparatus of claim 2 wherein each of the two lifting members is an elongate member, wherein each elongate lifting member is lateral to the spine and positioned in the mat to be generally under the angle of the ribs of the patient.

4. The lymphatic pump apparatus of claim 3 wherein each of the lifting members comprises at least one inflatable chamber, and wherein the apparatus further comprises a fluid pump for inflating and deflating the lifting members.

5. The lymphatic pump apparatus of claim 4 wherein each of the lifting members comprises a plurality of inflatable chambers.

6. The lymphatic pump apparatus of claim 5 wherein each of the plurality of inflatable chambers is separately inflatable.

7. The lymphatic pump apparatus of claim 6 wherein the inflatable chambers are adapted to inflated with air.

8. The lymphatic pump apparatus of claim 7 wherein the control assembly is adapted to operate the two lifting members alternatingly.

9. The lymphatic pump apparatus of claim 8 wherein the mat comprises a resilient layer and a cover.

10. The lymphatic pump apparatus of claim 9 wherein the mat further comprises a reinforced layer.

11. The lymphatic pump apparatus of claim 10 wherein the reinforced layer comprises a plurality of ribs.

12. The lymphatic pump apparatus of claim 1 wherein the mat comprises a resilient layer and a cover.

13. The lymphatic pump apparatus of claim 12 wherein the mat further comprises a reinforced layer.

14. The lymphatic pump apparatus of claim 13 wherein the reinforced layer comprises a plurality of ribs.

15. The lymphatic pump apparatus of claim 1 wherein the control assembly is adapted to coordinate the operation of the lifting assembly with an artificial respiratory device in use on the patient.

16. The lymphatic pump apparatus of claim 1 wherein the control assembly is adapted to automatically cycle the lifting assembly through alternating rest phases, in which the lift assembly remains retracted, and operating phases, in which the lift assembly operates continuously.

* * * * *